US006715863B2

(12) United States Patent
Shimizu

(10) Patent No.: US 6,715,863 B2
(45) Date of Patent: Apr. 6, 2004

(54) INK JET RECORDING DEVICE

(75) Inventor: Yoichiro Shimizu, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/178,572

(22) Filed: Jun. 25, 2002

(65) Prior Publication Data

US 2002/0196318 A1 Dec. 26, 2002

(30) Foreign Application Priority Data

Jun. 26, 2001 (JP) ..... 2001-192627

(51) Int. Cl.[7] ..... B41J 2/175
(52) U.S. Cl. ..... 347/85
(58) Field of Search ..... 347/84–87, 32, 347/93, 89

(56) References Cited

U.S. PATENT DOCUMENTS 5,793,395 A * 8/1998 Tanaka et al. ..... 347/85
6,032,010 A * 2/2000 Kim et al. ..... 347/86
6,217,164 B1 * 4/2001 Hino ..... 347/85

* cited by examiner

*Primary Examiner*—Russell Adams
*Assistant Examiner*—An H. Do
(74) *Attorney, Agent, or Firm*—Oliff & Berridge, PLC

(57) ABSTRACT

An ink jet recording device providing a stable fluid coupling from an ink accumulation tank to a head unit. A joint portion is provided at which a plurality of primary side ink paths and a plurality of secondary side ink paths are coupled together at one to one correspondence. The joint portion includes a main frame fixed to the head unit. Primary side first and second connecting portions those connected to the primary side ink paths are provided integrally with the main frame. Secondary side first and second connecting portions those connected to the secondary side ink paths are joined to the primary side first and second connecting portions, respectively by ultrasonic melt-bonding. The secondary side first and second connecting portions are separated from each other.

20 Claims, 5 Drawing Sheets

PRIOR ART

INK JET RECORDING DEVICE

BACKGROUND OF THE INVENTION

The present invention relates to an ink jet recording device, and more particularly, to a tube connection type ink jet recording device in which an ink is supplied from an external ink tank to an ink ejection head through a tube.

In a conventional tube connection type ink jet recording device, an ink tank accumulating therein an ink is fluidly connected by a tube to an ink ejection head from which an ink is ejected toward an image recording medium to form an inked image. FIG. 5 shows the conventional tube connection type ink jet recording device in which two ink ejection heads 1 are connected to first ink supply tube 2 and a second ink supply tube 3 by way of a joint member 4. In FIG. 5, only one ink ejection head 1 is shown. The other ink ejection head is juxtaposed along the ink ejection head 1 in a thickness direction of the drawing sheet. These ink ejection heads 1 are held by a head holder 15.

The joint member 4 includes an outer member 5 and a separate inner member 6 those formed of a resin. The outer member 5 includes a first outer side connecting portion 7 and a second outer side connecting portion 8 provided integrally therewith. The inner member 6 includes a first inner side connecting portion 10, a second inner side connecting portion 12 and outermost two leg portions 16 those provided integrally with each other.

A filter 17 is interposed between the first outer side connecting portion 7 and the first inner side connecting portion 10, and another filter 17 is interposed between the second outer side connecting portion 8 and the second inner side connecting portion 12. While maintaining this state, the first outer and inner side connecting portions 7 and 10 and the second outer and inner side connecting portions 8 and 12 are subjected to ultrasonic melt-bonding for joining the outer and inner members 5 and 6 together.

A first ink supply tube 2 is connected to the first outer side connecting portion 7, and a second ink supply tube 3 is connected to the second outer side connecting portion 8. Further, one of the ink ejection heads 1 has a first ink supply port 13 to which one end of a first ink supply conduit 9 is connected. The first ink supply conduit 9 has another end connected to the first inner side connecting portion 10.

Remaining ink ejection head 1 has a second ink supply port 14 to which one end of a second ink supply conduit 11 is connected. The second ink supply conduit 11 has another end connected to the second inner side connecting portion 12. With such a connecting condition, the leg portions 16 of the inner member 6 is fixed to the head holder 15 by means of screws 18. Thus, the assembly of the ink jet recording device is completed.

With such an arrangement, severe dimensional accuracy of the outer and inner members 5 and 6 must be required, otherwise insufficient jointing occurs between the outer and the inner members 5 and 6, and one of the members 5 or 6 may be easily peeled off from the remaining member 6 or 5. To be more specific, upon ultrassonic melt-bonding between the first outer and inner side connecting portions 7 and 10 and between the second outer and inner side connecting portions 8 and 12 after positional alignment between the portions 7 and 10 and between the portions 8 and 12 to provide joint portions between the members 7 and 10 and between the members 8 and 12, tensile force or compressive force may be generated between the joint portions, if a distance between the first and second outer side connecting portions 7 and 8 of the outer member 5 and a distance between the first and second inner side connecting portions 10 and 12 of the inner member 6 are not accurately provided. Further, due to the application of tensile force or compressive force to the joint portions, filters 17 at the joint portions may be damaged.

SUMMARY OF THE INVENTION

It is an object of the present invention to overcome the above-described problem and to provide an ink jet recording device capable of facilitating and ensuring assembly particularly of the joint portions serving as a coupling of a plurality of ink passages.

Another object of the present invention is to provide such ink jet recording device having a simple construction, yet providing complete assembly between inner and outer members without any peeling off therebetween with lesser influence of dimensional inaccuracy of the inner and outer members.

These and other objects of the present invention will be attained by an ink jet recording device having a joint portion where a plurality of fluid paths are coupled, the joint portion including a primary side connecting portion and a secondary side connecting portion. The primary side connecting portion has a plurality of primary fluid connecting portions to which a plurality of primary side fluid paths are connected. The secondary side connecting portion has a plurality of secondary fluid connecting portions to which a plurality of secondary side fluid paths are connected. Each primary fluid connecting portion is in correspondence with each secondary fluid connecting portion. One of the primary side connecting portion and the secondary side connecting portion is provided integrally. In the remaining one of the primary side connecting portion and the secondary side connecting portion, at least one of the fluid connecting portions is separated from the remaining fluid connecting portions.

In another aspect of the invention, there is provided a fluid coupling unit for coupling a plurality of primary set of fluid paths with a secondary set of fluid paths. The coupling unit includes the above described primary side connecting portion and secondary side connecting portion.

DETAILED DESCRIPTION OF THE PREFERRED EMBODIMENTS

Figure 1:
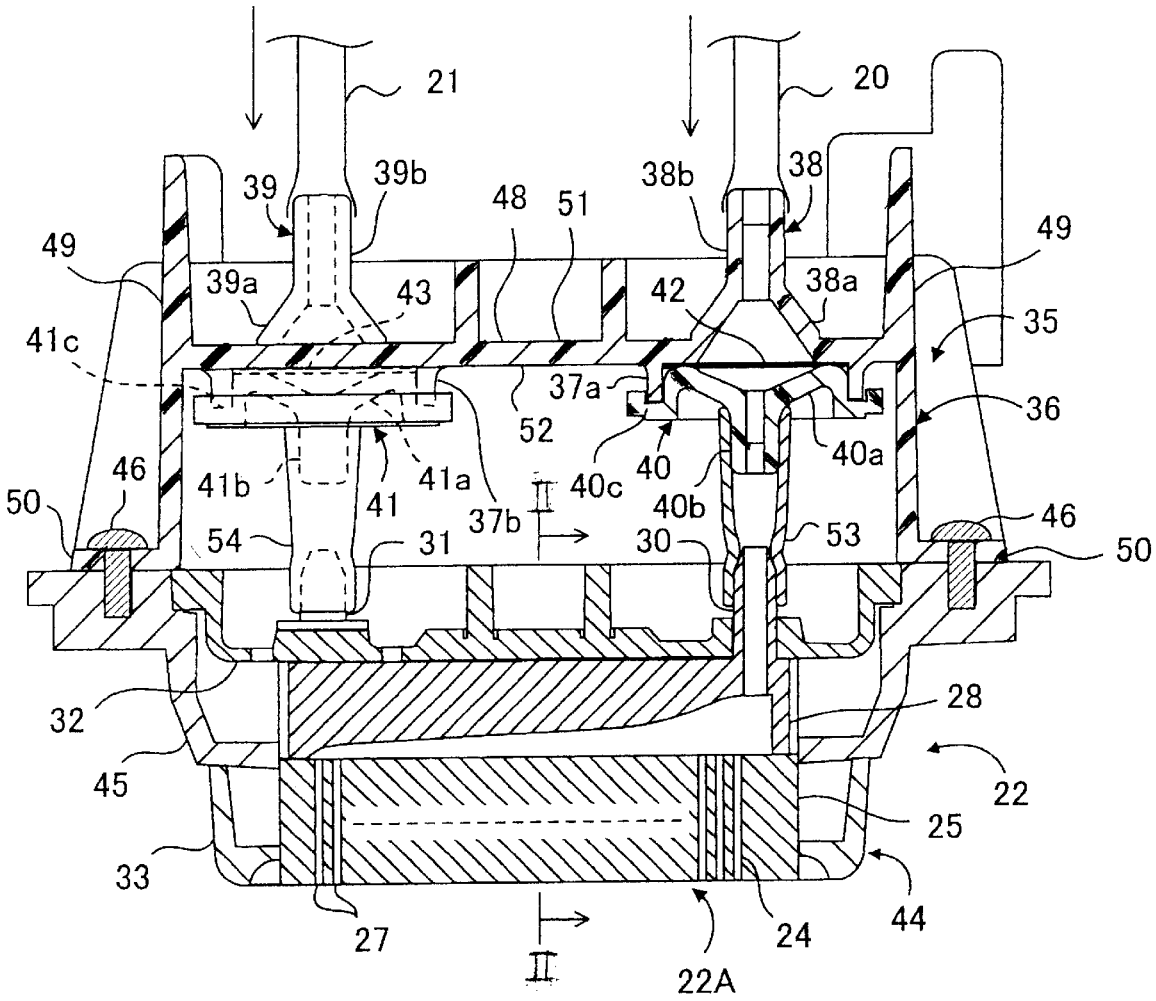
FIG. 1 is a cross-sectional view showing a joint member and a head unit incorporated in an ink jet recording device according to a first embodiment of the present invention.
Figure 2:
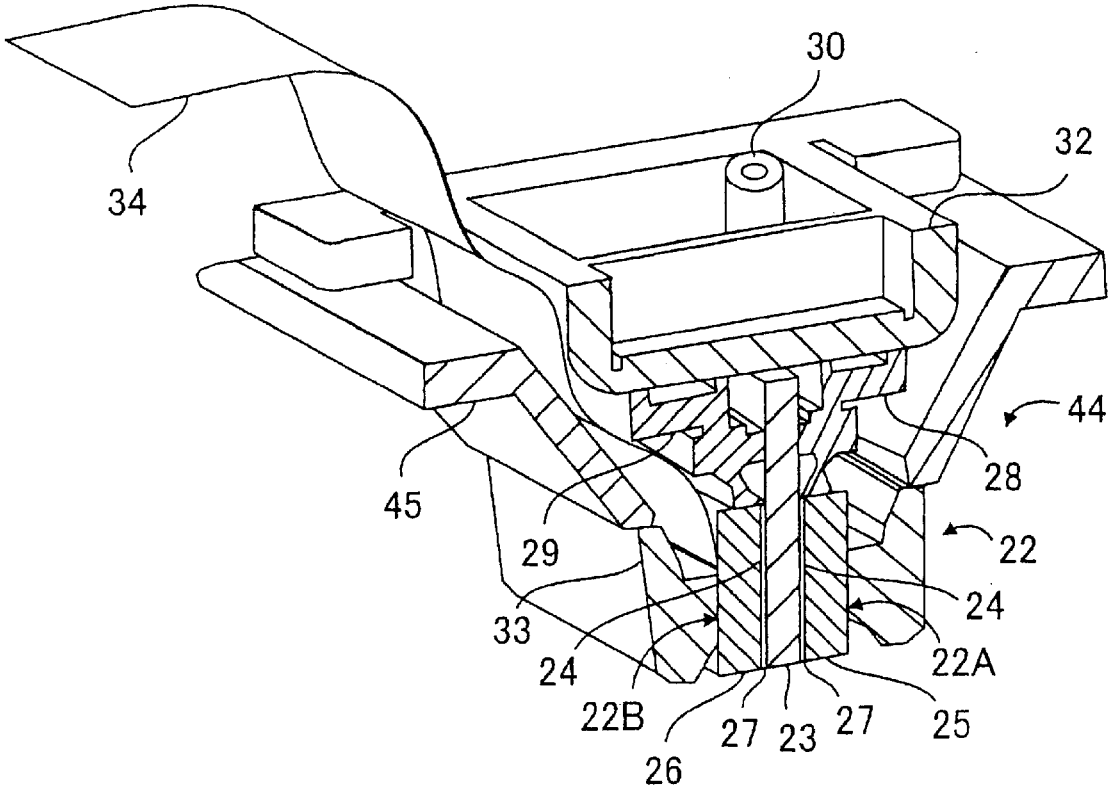
FIG. 2 is a perspective view including a cross-sectional view taken along the line II—II of FIG. 1 showing the ink jet recording device according to the first embodiment.

An ink jet recording device according to a first embodiment of the present invention will be described with reference to FIGS. 1 and 2. The ink jet recording device includes an ink tank (not shown) for accumulating an ink, and a head unit 44 serving as an ink ejection head mounted on a carriage (not shown). The head unit 44 includes a recording head 22. The ink tank is connected with a first ink supply tube 20 and a second ink supply tube 21, those serving as primary ink passages. The head unit 44 is attached with a joint member 35. Thus, the ink accumulated in the ink tank is supplied to the joint member 35 through the first and second ink supply tubes 20 and 21, and is then supplied to the recoding head 22 from the joint member 35 for ink ejection from the recording head 22 to provide an inked image on an image recording medium.

The head unit 44 has the recording head 22 and a head holder 45 for holding the recording head 22. As best shown in FIG. 2, the recording head 22 includes a center plate 23, a first head member 22A positioned at one side of the center plate 23 and a second head member 22B positioned at opposite side of the center plate 23. The first head member 22A includes a first actuator 25 and a first manifold 28, and the second head member 22B includes a second actuator 26 and a second manifold 29. The first actuator 25 is adhesively fixed to the one side face of the center plate 23, and the second actuator 26 is adhesively fixed to the opposite side face thereof. The adhesive surfaces of the first and second actuators 25 and 26 are formed with a plurality of grooves, and a combination of each surface of the center plate 23 and the plurality of grooves defines a plurality of ink ejection channels 24 arrayed in two rows. Each lowermost end of each ejection channel 24 functions as a nozzle 27. A flexible power supply 34 is provided between the head holder 45 and an attachment plate 32 (described later) for transmitting ejection pulse signals to the first and second actuators 25 and 26.

The first and second manifolds 28, 29 are provided symmetrically with respect to the center plate 23 and extend in a direction of an array of the ejection channels 24. The first and second manifolds 28, 29 are connected to upper ends of the first and second actuators 25, 26, respectively. The first and second manifolds 28, 29 are integrally provided with first and second connection tubes 30, 31 protruding upwardly therefrom. These first and second connection tubes 30, 31 are connected to first and second supply conduits 53, 54, respectively serving as secondary ink passages. Thus, ink supplied from the first and second connection tubes 30, 31 is distributingly introduced into each ink ejection channel 24. The first and second connection tubes 30, 31 are positioned away from each other (left and right ends in FIG. 1) in a longitudinal direction of the center plate 23, and are positioned in a rotational symmetrical manner about a longitudinal center of the center plate 23.

After inks from the first and second connection tubes 30, 31 are introduced into the ejection channels 24 of the first and second actuators 25, 26 of the first and second head members 22A, 22B, respectively through the first and second manifolds 28, 29, respectively, ejection pulse signals are transmitted through the power supply 34 to drivingly deform the first and second actuators 25, 26. For example, ink droplets are ejected from the nozzles 27 upon reduction in volume of the first and second actuators 25, 26, and inks are again introduced into the ejection channels 24 of these actuators 25,26 by way of the first and second manifolds 28,29 upon increase in volume of these actuators 25, 26. Such operations are repeatedly performed to provide a desired inked image on the image recording medium.

The head holder 45 held by the carriage (not shown) has an opening in which the recording head 22 is held. The attachment plate 32 is held on an upper surface of the head holder 45 and positioned in the opening and immediately above the recording head 22. A cover 33 is disposed below the opening. The cover 33 covers the lower surface of the recording head 33 while allowing the nozzles 27 to be exposed.

The attachment plate 32 is formed with diagonally positioned through holes through which first and second connection tubes 30, 31 extend. That is, the first connection tube 30 protrudes from one of the through holes and is connected to the manifold 28, and the second connection tube 31 protrudes from the other thorough holes and is connected to the manifold 29. Upper surfaces of the manifolds 28, 29 are adhesively bonded to the lower surface of the attachment plate 32. Thus, the recording head 22 is held by the head holder 45 through the attachment plate 32 while being received in the opening of the head holder 45.

The joint member 35 includes a main frame 36 having an H-shape in cross-section, first and second outer side connecting portions 38, 39 serving as primary side connecting portions, first and second inner side connecting portions 40, 41 serving as secondary side connecting portions, and first and second filters 42, 43.

The main frame 36 has a horizontally extending support wall 48 and leg portions 49 extending vertically from each end of the support wall 48. The first and second outer connecting portions 38, 39 integrally extend upwardly from an upper surface 51 of the support wall 48. The first and second outer connecting portions 38, 39 are positioned diagonally in such a manner that these first and second outer connecting portions 38, 39 are brought into alignment with the first and second connecting tubes 30, 31 when the joint member 35 is attached to the head unit 44. The first and second outer connecting portions 38, 39 include upper funnel shaped portions 38*a*, 39*a* having lower ends open to the upper surface 48 and diameters gradually reduced upwardly, and sleeve portions 38*b*, 39*b* positioned above and integrally with the upper funnel shaped portions 38*a*, 39*a*.

The support wall 48 has a lower surface 52 integrally provided with two melt bonding portions 37*a*, 37*b* adapted to be melt-bonded with first and second inner side connecting portions 40, 41 described later. The melt bonding portions 37*a*, 37*b* are positioned in alignment with the first and second outer connecting portions 38, 39, respectively, and have ring shape protruding downwardly from the lower surface 52. The leg portion 49 has an L-shape in cross-section having attachment bases 50 in contact with the head holder 45. Screws 46 threadingly extend through the bases 50 and the head holder 45 for fixing the main frame 36 to the head holder 45.

The first inner side connecting portions 40 is separate from the second inner side connecting portion 41. The first and second inner side connecting portions 40, 41 include lower funnel shaped portions 40*a*, 41*a* whose diameters are gradually reduced downwardly, sleeve portions 40*b*, 41*b* positioned below and integrally with the lower funnel shaped portions 40*a*, 41*a*, and annular flanged portions provided at upper outer peripheral portions of the funnel shaped portions 40*a*, 41*a*. The flanged portions are formed with the annular recessed portions 40*c*, 41*c* engageable with the ring-shaped melt-bonding portions 37*a*, 37*b*. These lower funnel shaped portions 40*a*, 41*a*, the sleeve portions 40*b*, 41*b* and the annular flanged portions are formed integrally.

First and second filters 42, 43 are interposed between upper and lower funnel shaped portions 38*a* and 40*a* and between the upper and lower funnel shaped portions 39*a* and 41*a*. The first and second filters 42, 43 have disc shape and have diameters sized to be interposed between the upper and lower funnel shaped portions.

For assembling the joint member 35, the first and second inner side connecting portions 40, 41 are aligned with the first and second outer side connecting portions 38, 39 respectively, and then, the first and second filters 42, 43 are interposed between the upper and lower funnel shaped portions 38*a* and 40*a* and between the upper and lower funnel shaped portions 39*a* and 41*a*. Then, the annular recesses 40*c*, 41*c* are brought into engagement with the melt-bonding portions 37*a*, 37*b* of the support wall 48. The first and second inner side connecting portions 40, 41 are then be melt-bonded to the melt bonding portions 37*a*, 37*b* by means of ultrasonic melt-bonding. Thus, the first and second outer side connecting portions 38 and 39 can be connected to the first and second inner side connecting portions 40 and 41, respectively.

For providing fluid communication between the joint member 35 and the head unit 44, the lower sleeve portions 40*b* and 41*b* of the first and second inner side connecting portions 40, 41 are brought into alignment with the first and second connecting tubes 30, 31, respectively. Then the lower ends of the first and second supply conduits 53, 54 are connected to the first and second connecting tubes 30, 31, respectively, and upper ends of the first and second supply conduits 53, 54 are connected to the lower sleeve portions 40*b*, 41*b*, respectively. As a result, the first and second ink supply tubes 20, 21 are fluidly connected to the first and second connecting tubes 30, 31 of the first and second manifolds 28, 29, respectively, through the first and second outer side connecting portions 38,39, the first and second inner side connecting portions 40, 41, and the first and second supply conduits 53, 54, respectively. Then, the bases 50 of the leg portions 49 are attached to the head holder 45 by means of the screws 46, thereby supporting the joint portion 35 onto the head holder 45.

In the joint member 35, the first and second outer connecting portions 38 and 39 are provided integrally with the support wall 48, whereas the first inner connecting portion 40 is provided separately from the second inner connecting portion 41. Therefore, ultrasonic melt bonding operation between the support wall 48 and the first inner connecting portion 40 at a position adjacent the first outer connecting portion 38 does not affect ultrasonic melt bonding operation between the support wall 48 and the second inner connecting portion 41 at a position adjacent the second outer connecting portion 39. Thus, no severe dimensional accuracy is required in terms of the distance between the first and second outer connecting portions 38 and 39, and no tensile force, compressive force and strain are generated in the joint member 35. Consequently, sufficient joining between the first outer and inner connecting portions 38 and 40 and between the second outer and inner connecting portions 39 and 41 can result with such a simple construction, and interposed first and second filters 41, 43 can be protected from any damage because of no application of tensile force and compressive force thereto.

Further, in the joint member 35, not only the first and second outer connecting portions 38 and 39 but also the leg portions 49 are integral with the main frame 36. Therefore, the joint member 35 can be stably fixed to the head holder 45. Moreover, because the first and second inner connecting portions 40, 41 are disposed within a space defined by the legs, these first and second inner connecting portions 40, 41 can be protected by the legs 49. Consequently, the melt bonding connection of these first and second inner connecting portions 40, 41 to the first and second outer connecting portions 38, 39 can be maintained for a long duration.

Accordingly, because such an improved joint member 35 is attached to the head unit 44, stabilized ink supply to the head unit 44 can be provided to perform a stabilized ink ejection, which is advantageous for the tube connection type ink jet recording device to ensure accurate and stable image forming operation.

An ink jet recording device according to a second embodiment of the present invention will be described with reference to FIG. 3, wherein like parts and components are designated by the same reference numerals plus 100 as those shown in the first embodiment. In the first embodiment, the first and second ink supply tubes 20, 21 supply ink to the first and second head members 22A and 22B, respectively. On the other hand, according to the second embodiment, ink recirculation is achievable by making one of tubes 120 as an ink inlet tube, and making another tube 121 as an ink outlet tube.

Figure 3:
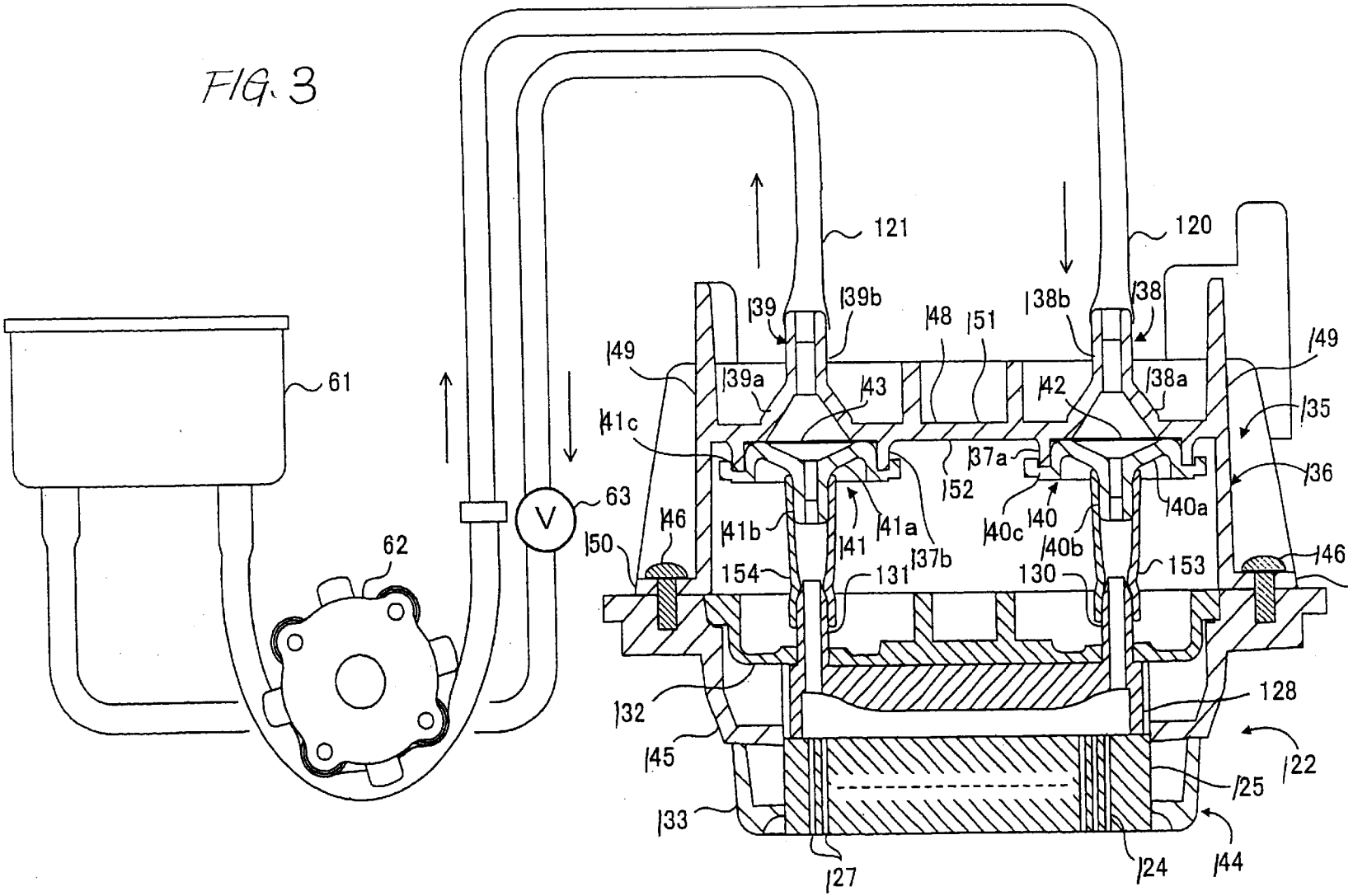
FIG. 3 is a cross-sectional view showing a joint member, a head unit, and an ink circulation system those constituting an ink jet recording device according to a second embodiment of the present invention.

As shown in FIG. 3, each one end of the ink inlet tube 120 and ink outlet tube 121 is connected to an ink accumulation tank 61 and each another end of the tube 120, 121 is connected to a joint member 135 to provide ink recirculation between the ink accumulating tank 61 and a recording head 122 for removing bubbles generated in the ink when the ink is returned into the tank 61. A pump 62 is provided at the ink inlet tube 120 for positively supplying ink from the ink tank 61 to the recording head 122, and a one-way valve 63 is provided at the ink outlet tube 121 for avoiding backflow of the ink.

The joint member 135 has first and second outer connecting portions 138 and 139 and first and second inner connecting portions 140, 141. However, the first and second connecting portions 138 and 139 are not positioned diagonally, but are positioned in alignment with each other in the longitudinal direction of the recording head 122 (see cross hatching of both connecting portions 138 and 139 in FIG. 3). Similarly, the first and second inner connecting portions 140 and 141 are not positioned diagonally, but are positioned in alignment with each other in the longitudinal direction of the recording head 122 (see cross hatching of both connecting portions 140 and 141 in FIG. 3). These connecting portions 138, 139, 140, 141 are in communication with an identical manifold 128 of the recording head 122. To this effect, first and second connection tubes 130 and 131 both extend upwardly from the identical manifold 128. Further, a supply conduit 153 is connected between the first inner connecting portion 140 and the first connection tube 130, and a return conduit 154 is connected between the second inner connecting portion 141 and the second connection tube 131. Remaining arrangement is the same as that of the first embodiment.

With this arrangement, upon actuation of the pump 62, the ink in the ink accumulation tank 61 is delivered to the manifold 128 through the ink inlet tube 120, the first outer connecting portion 138, the first inner connecting portion 140, the ink supply conduit 153, and the first connecting tube 130. The ink accumulated in the manifold 128 is returned to the ink accumulation tank 61 through the second connecting tube 131, the return conduit 154, the second inner connecting portion 141, the second outer connecting portion 139 and the ink outlet tube 121.

Similar to the first embodiment, in the second embodiment, the first and second outer connecting portions 138, 139 are provided integrally with a support wall 148, whereas the first inner connecting portion 140 and the second inner connecting portion 141 are provided separately from each other. Therefore, connection between the first outer and inner connecting portions 138 and 140 can be made independently of the connection between the second outer and inner connecting portions 139 and 141. Consequently, dimensional inaccuracy in respect of the distance between the first and second outer connecting portions 138 and 139 does not affect the connection between the first outer and inner connecting portions 138 and 140 and between the second outer and inner connecting portions 139 and 141. Thus, stable connection results to maintain stable ink ejecting operation for a long duration, since no compressive or tensile force is applied to the melt-bonding portions 140*c*, 141*c*.

Figure 4:
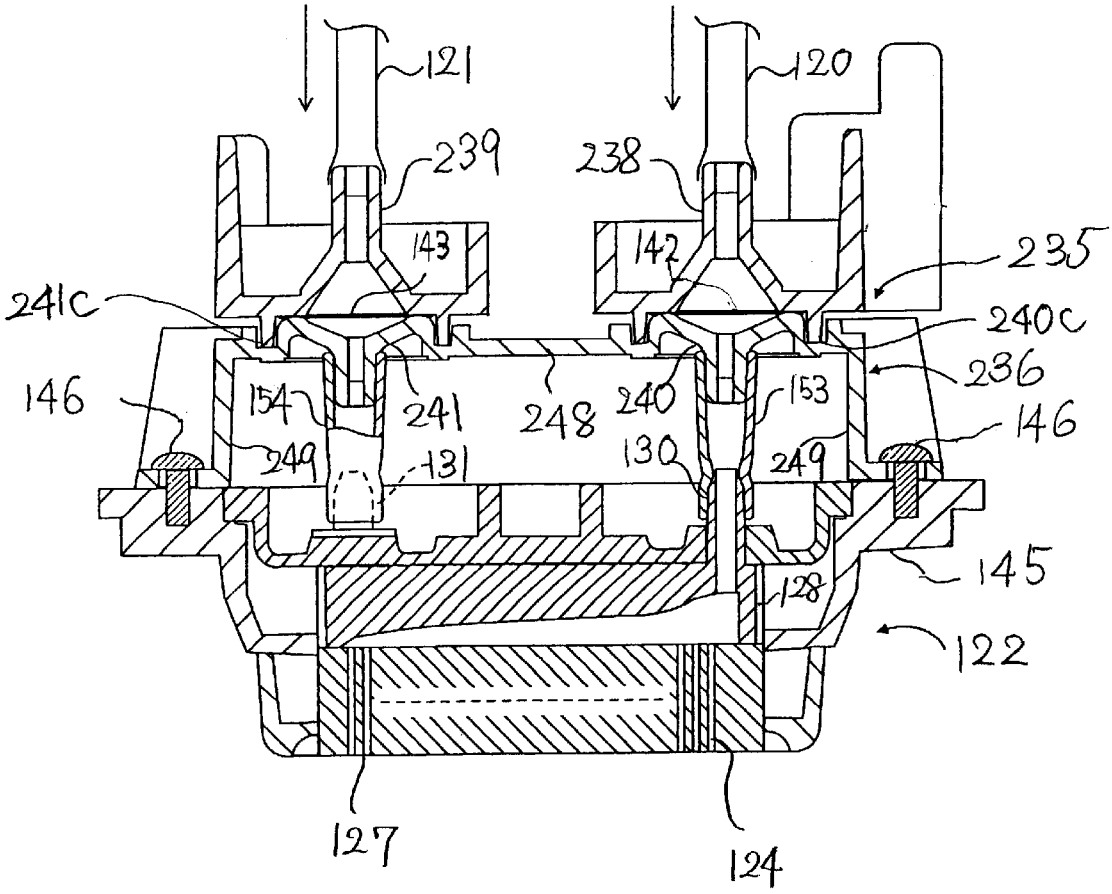
FIG. 4 is a cross-sectional view showing a joint member and a head unit those incorporated in an ink jet recording device according to a third embodiment of the present invention.
Figure 5:
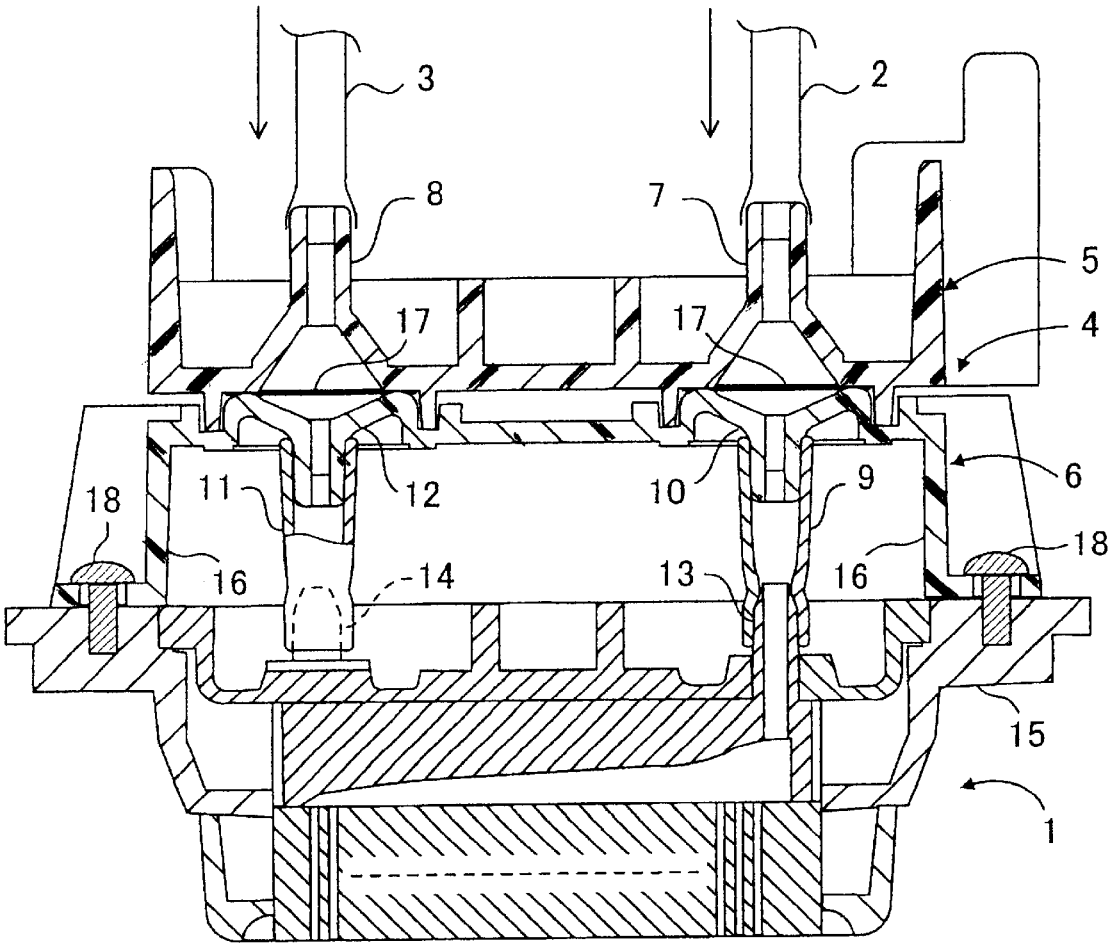
FIG. 5 is a cross-sectional view showing a joint member and a head unit those incorporated in a conventional ink jet recording device.

FIG. 4 shows an ink jet recording device according to a third embodiment of the present invention. The third embodiment is a modification to the second embodiment. In the first and second embodiments, the outer connecting portions 38 and 39 or 138 and 139 are provided integrally with each other, whereas the inner connecting portions 40 and 41 or 140 and 141 are provided separately from each other. In the third embodiment, a joint member 235 has outer connecting portions 238 and 239 provided separately from each other, and inner connecting portions 240 and 241 provided integrally with each other. To be more specific, a horizontally extending support wall 248 has legs 249 which are fixed to the head holder 145, and the first and second inner connecting portions 240, 241 are provided integrally with the support wall 248.

In the third embodiment, the first and second inner connecting portions 240, 241 are provided integrally with the support wall 248, whereas the first outer connecting portion 238 and the second outer connecting portion 239 are provided separately from each other. Therefore, connection between the first outer and inner connecting portions 238 and 240 can be made independently of the connection between the second outer and inner connecting portions 239 and 241. Consequently, dimensional inaccuracy in respect of the distance between the first and second inner connecting portions 240 and 241 does not affect the connection between the first outer and inner connecting portions 238 and 240 and between the second outer and inner connecting portions 239 and 241. Thus, stable connection results to maintain stable ink ejecting operation for a long duration, since no compressive or tensile force is applied to the melt-bonding portions 240*c* 241*c*.

While the invention has been described in detail with reference to specific embodiments thereof, it would be apparent to those skilled in the art that various changes and modifications may be made therein without departing from the spirit and scope of the invention.

For example, in the above described embodiments, the joint member 35, 135 have two outer connecting portions 38 and 39, or 138 and 139, and two inner connecting portions 40 and 41 or 140 and 141. However, the numbers of the connecting portions is not limited to two. Provided that not less than two outer connecting portions are provided integrally, and if not less than two inner connecting portions are provided, at least one of the inner connecting portions can be made separately from the remaining inner connecting portions. Of course each inner connecting portion can be made separate from each other. The same is true with respect to the outer connecting portions. Provided that not less than two inner connecting portions are provided integrally, and if not less than two outer connecting portions are provided, each outer connecting portion can be separately provided from each other. In any event, at least one of the outer connecting portions can be made separately from the remaining outer connecting portions.

Further, in the first embodiment, a buffer tank can be connected at upstream side of the first and second outer connecting portions 38 and 39 for temporarily accumulating ink supplied from an external tank in the buffer tanks. In this case, the same ink can be delivered to the first and second head members 22A and 22B.

Furthermore, although the third embodiment is the modification to the second embodiment of ink recirculation type, the third embodiment can also be the modification to the first embodiment.

What is claimed is:

1. An ink jet recording device having a joint portion where a plurality of fluid paths are coupled, the joint portion comprising: a primary side connecting portion having a plurality of primary fluid connecting portions to which a plurality of primary side fluid paths are connected; and a secondary side connecting portion having a plurality of secondary fluid connecting portions to which a plurality of secondary side fluid paths are connected, each primary fluid connecting portion being in correspondence with each secondary fluid connecting portion, only one of the primary side connecting portion and the secondary side connecting portion having their respective fluid connecting portions connected integrally, and a remaining one of the primary side connecting portion and the secondary side connecting portion having their respective fluid connecting portions being separated.

2. The ink jet recording device as claimed in claim 1, further comprising a plurality of filters each interposed between each primary fluid connecting portion and each secondary fluid connecting portion.

3. The ink jet recording device as claimed in claim 1, further comprising an ink receiving portion receiving an ink from the plurality of secondary side fluid paths, and wherein the joint portion comprises an attachment portion attached to the ink receiving portion, the one of the primary side connecting portion and the secondary side connecting portion provided integrally being integrally with the attachment portion.

4. The ink jet recording device as claimed in claim 3, wherein the ink receiving portion comprises a head unit including an actuator formed with ink channels.

5. The ink jet recording device as claimed in claim 1, wherein the plurality of primary fluid connecting portions of the primary side connecting portion are provided integrally with each other, and the plurality of secondary fluid connecting portions of the secondary side connecting portion are separated from each other, each primary fluid connecting portion and each secondary fluid connecting portion being melt-bonded to each other.

6. The ink jet recording device as claimed in claim 5, further comprising a plurality of filters each interposed between each primary fluid connecting portion and each secondary fluid connecting portion.

7. The ink jet recording device as claimed in claim 5, wherein each primary fluid connecting portion and each secondary fluid connecting portion being melt-bonded to each other by ultrasonic bonding.

8. The ink jet recording device as claimed in claim 5, further comprising an ink receiving portion receiving an ink from the plurality of secondary side fluid paths, and wherein the joint portion comprises an attachment portion attached to the head unit, the primary side connecting portion provided integrally with the attachment portion.

9. The ink jet recording device as claimed in claim 8, wherein a combination of the primary side connecting portion, the attachment portion, and the ink receiving portion provides an internal protective space thereamong, the plurality of secondary fluid connecting portions of the secondary side connecting portion being positioned within the protective space.

10. The ink jet recording device as claimed in claim 8, wherein the ink receiving portion comprises a head unit including an actuator formed with ink channels.

11. The ink jet recording device as claimed in claim 10, wherein the head unit comprises a first head member and a second head member disposed side by side;

and wherein the plurality of primary fluid connecting portions comprises a first primary fluid connecting portion, and a second primary fluid connecting portion positioned diagonally with respect to the first primary fluid connecting portion, and wherein the plurality of secondary fluid connecting portions comprises a first secondary fluid connecting portion in alignment with the first primary fluid connecting portion, and a second secondary fluid connecting portion in alignment with the second primary fluid connecting portion and positioned diagonally with respect to the first secondary fluid connecting portion, the first secondary fluid connecting portion being in communication with the first head member and the second secondary fluid connecting portion being in communication with the second head member.

12. The ink jet recording device as claimed in claim 10, further comprising:

an ink accumulation tank accumulating therein an ink;

an ink inlet tube connected to the ink accumulation tank;

an ink outlet tube connected to the ink accumulating tank; and a pump drivingly supplying the ink in the ink accumulation tank into the ink inlet tube.

13. The ink jet recording device as claimed in claim 12, wherein the plurality of primary fluid connecting portions comprises a first primary fluid connecting portion connected to the ink inlet tube, and a second primary fluid connecting portion connected to the ink outlet tube, and wherein the plurality of secondary fluid connecting portions comprises a first secondary fluid connecting portion in alignment with the first primary fluid connecting portion, and a second secondary fluid connecting portion in alignment with the second primary fluid connecting portion, the first and second secondary fluid connecting portion being in communication with an identical actuator.

14. The ink jet recording device as claimed in claim 12, further comprising a one-way valve provided at the ink outlet tube for preventing the ink from flowing from the ink accumulation tank to the actuator.

15. A fluid coupling unit for coupling a plurality of primary set of fluid paths with a secondary set of fluid paths, comprising: a primary side connecting portion having a plurality of primary fluid connecting portions to which the plurality of primary set of fluid paths are connected; and a secondary side connecting portion having a plurality of secondary fluid connecting portions to which the plurality of secondary set of fluid paths are connected, each primary fluid connecting portion being in correspondence with each secondary fluid connecting portion, only one of the primary side connecting portion and the secondary side connecting portion having their respective fluid connecting portions connected integrally, and a remaining one of the primary side connecting portion and the secondary side connecting portion having their respective fluid connecting portions being separated.

16. The fluid coupling unit as claimed in claim 15, further comprising a plurality of filters each interposed between each primary fluid connecting portion and each secondary fluid connecting portion.

17. The fluid coupling unit as claimed in claim 15, further comprising:

a fluid receiving portion receiving a fluid from the secondary set of fluid paths; and an attachment portion attached to the fluid receiving portion, the one of the primary side connecting portion and the secondary side connecting portion provided integrally being integrally with the attachment portion.

18. The fluid coupling unit as claimed in claim 17, wherein the fluid receiving portion comprises a head unit for use in an ink jet recording device, the head unit including an actuator formed with ink channels.

19. The fluid coupling unit as claimed in claim 15, wherein the plurality of primary fluid connecting portions of the primary side connecting portion are provided integrally with each other, and the plurality of secondary fluid connecting portions of the secondary side connecting portion are separated from each other, each primary fluid connecting portion and each secondary fluid connecting portion being melt-bonded to each other.

20. The fluid coupling unit as claimed in claim 19, further comprising:

a fluid receiving portion receiving a fluid from the secondary set of fluid paths; and an attachment portion attached to the fluid receiving portion, the primary side connecting portion provided integrally with the attachment portion, a combination of the primary side connecting portion, the attachment portion, and the fluid receiving portion providing an internal protective space thereamong, the plurality of secondary fluid connecting portions of the secondary side connecting portion being positioned within the protective space.

* * * * *